US006006956A

United States Patent [19]

Jorgensen et al.

[11] Patent Number: 6,006,956

[45] Date of Patent: Dec. 28, 1999

[54] VALVE STABILIZING BRACKET FOR CHEMICAL CANISTER

[75] Inventors: Mark I. Jorgensen, Austin; John N. Gregg, Marble Falls, both of Tex.

[73] Assignee: Advanced Delivery & Chemical Systems, Ltd., Austin, Tex.

[21] Appl. No.: 08/989,498

[22] Filed: Dec. 12, 1997

[51] Int. Cl.[6] ..... B65D 83/00

[52] U.S. Cl. ..... 222/402.1; 222/173; 222/321.1

[58] Field of Search ..... 169/51, 75; 222/321.1, 222/173, 635, 288, 372, 402.1

[56] References Cited

U.S. PATENT DOCUMENTS

| | | | |
|---|---|---|---|
| 1,869,869 | 8/1932 | Smith | 222/321.1 |
| 3,702,157 | 11/1972 | Thomas | 169/51 |
| 5,793,280 | 8/1998 | Hincher | 169/51 |

*Primary Examiner*—Kevin Shaver
*Assistant Examiner*—David Deal
*Attorney, Agent, or Firm*—O'Keefe, Egan & Peterman, LLP

[57] ABSTRACT

A bracket assembly is provided for supporting and stabilizing valves or other accessories that are attached to chemical canisters. Such valves and related connectors are subject to damage and resulting leakage due to forces applied to them during shipment, handling, installation and use. In order to reduce such damage, a rigid baseplate is provided that can be attached to the port tube of a standard canister. Rigid angle brackets may be connected to the baseplate and to the valves to provide a strong, rigid support to hold the valves position relative to the canister. Such a bracket assembly removes stresses from conduits and sealed couplings between the valves and the canister, thus preventing damage to the couplings due to the application of external forces to the valves. The invention is also applicable to support other sorts of accessories mounted on canisters of various types and sizes.

10 Claims, 5 Drawing Sheets

VALVE STABILIZING BRACKET FOR CHEMICAL CANISTER

BACKGROUND OF THE INVENTION

1. Field of the Invention

The present invention provides an improvement to a chemical canister. In particular, a rigid bracket is provided that clamps to a sturdy element of the canister. Valves and other articles associated with the canister may be attached to the bracket for support and protection.

2. Background

Industrial chemicals are often shipped and stored in small canisters, for example, 2, 5 or 10 gallon canisters, such as so-called "1A1 " containers. In many instances, these canisters must be absolutely air-tight and leak-proof, either because the chemicals present health or environmental hazards or other dangers, or because the chemicals will become contaminated and unusable after even a slight exposure to air or other substances. Means are therefore provided in the art for filling, connecting, and using such canisters without exposing the chemicals contained therein to the environment.

Referring to FIG. 1, the top of a typical chemical canister is shown, as will be familiar to those having skill in the art. Canister top cap 12 is typically welded to canister body 14 to form an enclosed, sealed container. Top cap 12 may be provided with a port tube 16 which penetrates and is welded to top cap 12 (see FIG. 6). Port tube 16 cannot be seen in FIG. 1 because it is obscured by port tube nut 18, which sealably closes the external end of port tube 16. The external end of port tube 16 is typically threaded to engage nut 18 or other apparatus (such as a level sensor) that may be coupled thereto. Port tube 16 may typically be about 2 inches in diameter. The canister, port tube and other components of the canister assembly may be made of metal, typically stainless steel.

Top cap 12 is also typically fitted with several delivery tubes 20, which provide connections to the interior of the canister for filling and using the canister. Inside of the canister, a delivery tube may extend to near the bottom of the canister, forming a dip tube used for extracting fluid from the canister, or it may extend only a short distance into the canister. In a typical application, a dip tube is used to conduct the contents out of the canister, while a gas source is applied to another delivery tube to pressurize the canister and thereby force the fluid contained in the canister out through the dip tube. The outside of each delivery tube 20 is sealably connected to top cap 12, such as by welding. The end of each tube external to the canister is formed into a sealing gland for use in connecting the tube to other apparatus. In common applications the sealing gland is a "VCR" gland. A captive threaded nut or collar 22 is provided around each delivery tube 20 between the canister and the gland.

FIG. 2 shows a cross sectional view of a typical VCR connection. As is well known in the art, this type of connection may be used to provide an ultra-pure seal but is subject to damage and leaking. Lower gland 24 is connected to tube 20. Upper gland 26 is connected to other apparatus to be attached to the canister, such as valve 28 (see FIG. 1). Each gland has a precisely machined sealing surface 30, 32 and a compression shoulder 34, 36. To form the VCR connection, a VCR washer 40 is positioned between sealing surfaces 30 and 32. Compression shoulder 34 is engaged by an internal shoulder on threaded collar 22 (see FIG. 1), and compression shoulder 36 is engaged by an internal shoulder on opposing collar 23. Collars 22, 23 and connector body 38 have corresponding threads, and as they are threaded together they apply opposing compression forces to shoulders 34 and 36, thus compressing VCR washer 40 between sealing surfaces 30 and 32, effecting the required ultra-pure coupling. A similar VCR connection may be provided between the top end of VCR body 38 and valve 28 or blank plug 42.

While this patent refers to embodiments employing VCR couplings, the present invention applies equally to embodiments employing other types or arrangements of connectors and couplings. The references to VCR couplings are therefore exemplary and not limiting of the scope of the invention, which is defined by the claims that are appended hereto. Furthermore, references in this description to particular dimensions and canister configurations are also exemplary and are not intended to limit the scope of the invention.

It will be appreciated by those skilled in the art that a VCR connection is fragile, and that if an unusual force is applied to such a connection it may be damaged and lose its seal. As can be seen in FIG. 1, additional VCR couplings 44 or other types of connectors may be provided on top of valves 28 in order to provide attachment points for process piping when the canisters are filled or used. When process piping (not shown) is connected to the top of valve 28, valve 28 should be firmly supported ("backed-up") to avoid applying torque or bending forces to the VCR seal that is formed between valve 28 and tubing 20. If such support is not provided, the seal may be damaged.

Canisters are typically shipped with valves 28 and actuators 46 attached. If a canister is dropped or if a valve 28 is bumped during shipment or handling, the VCR seals between valve 28 and canister top cap 12 are a likely place for damage to occur, resulting in leakage from the canister or spoilage of its contents. If the canister contains toxic or hazardous materials, the occurrence of a leak can result in substantial cost and inconvenience. It is therefore imperative that apparatus be provided for preventing leaks from occurring in these seals.

It is thus desirable to provide a canister/valve arrangement that is less vulnerable to damage and leaking during shipping and handling than is known in the prior art described above. It is also desirable to provide a canister that may be quickly and easily attached to process piping without excessive concern for supporting or backing-up the valves and couplings that are mounted on the canister. It is further desirable to achieve these objectives without having to modify or to compromise the integrity of existing chemical canisters.

SUMMARY OF THE INVENTION

The present invention addresses the above-mentioned deficiencies in the prior art by providing a bracket that may be attached to a standard chemical canister and by providing rigid support to any valves or other accessories that are connected to the canister. In a preferred embodiment, the bracket comprises a rigid base plate that is clamped around a canister port tube to provide a rigid platform on top of the canister, beneath the valves. The base plate has a selected shape so that it can be installed around valve stems and other canister components. One or more angle brackets may be attached to the base plate by bolts or other means, and the angle brackets may also be securely attached to the valves. The bracket assembly according to this invention rigidly couples the valve bodies to the canister, thus preventing any bending or twisting forces from being applied to the VCR seals.

In a preferred embodiment, the base plate is split into a first plate and a second plate, which may be separated to install the base plate on a canister. The port tube is clamped between the first plate and the second plate, which are held together by base assembly bolts. Angle brackets are rigidly bolted to the base plate, and valves or other accessories may be connected to the angle brackets to secure them in a desired position relative to the body of the canister.

In one aspect, the invention is a removable bracket for supporting a valve in a fixed position with respect to a canister, the canister forming an enclosed interior volume, wherein the valve is operably connected to the interior volume of the canister by a conduit, the bracket comprising a first base plate half and a second base plate half, said first and second base plate halves cooperating to form a generally planar base plate that may be rigidly and removably attached to the canister, and a rigid angle bracket having a vertical flange and a horizontal flange, the vertical flange being removably connectable to the valve and the horizontal flange being connected to the base plate.

In another aspect, the invention is a canister assembly for containing fluids, comprising an enclosed canister, a conduit in communication with the interior of the canister extending external to the canister, a valve operably coupled to the conduit external to the canister, and a rigid stabilizing bracket removably attached to the canister and removably attached to the valve.

BRIEF DESCRIPTION OF THE DRAWINGS

It is to be noted that the appended drawings illustrate only particular embodiments of the invention and are, therefore, not to be considered limiting of its scope, for the invention may admit to other effective embodiments.

DETAILED DESCRIPTION OF THE INVENTION

Figure 1:
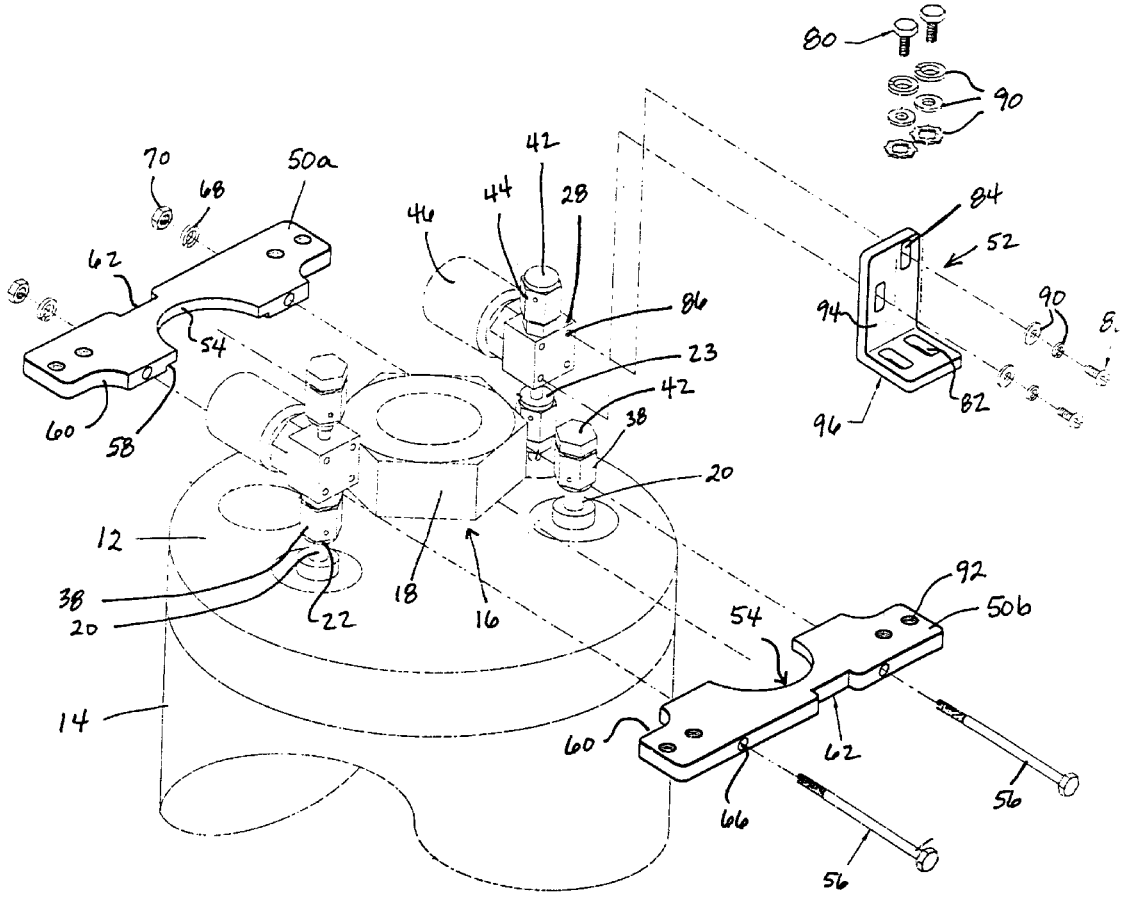
FIG. 1 is an isometric exploded illustration of a bracket formed in accordance with the present invention.
Figure 2:
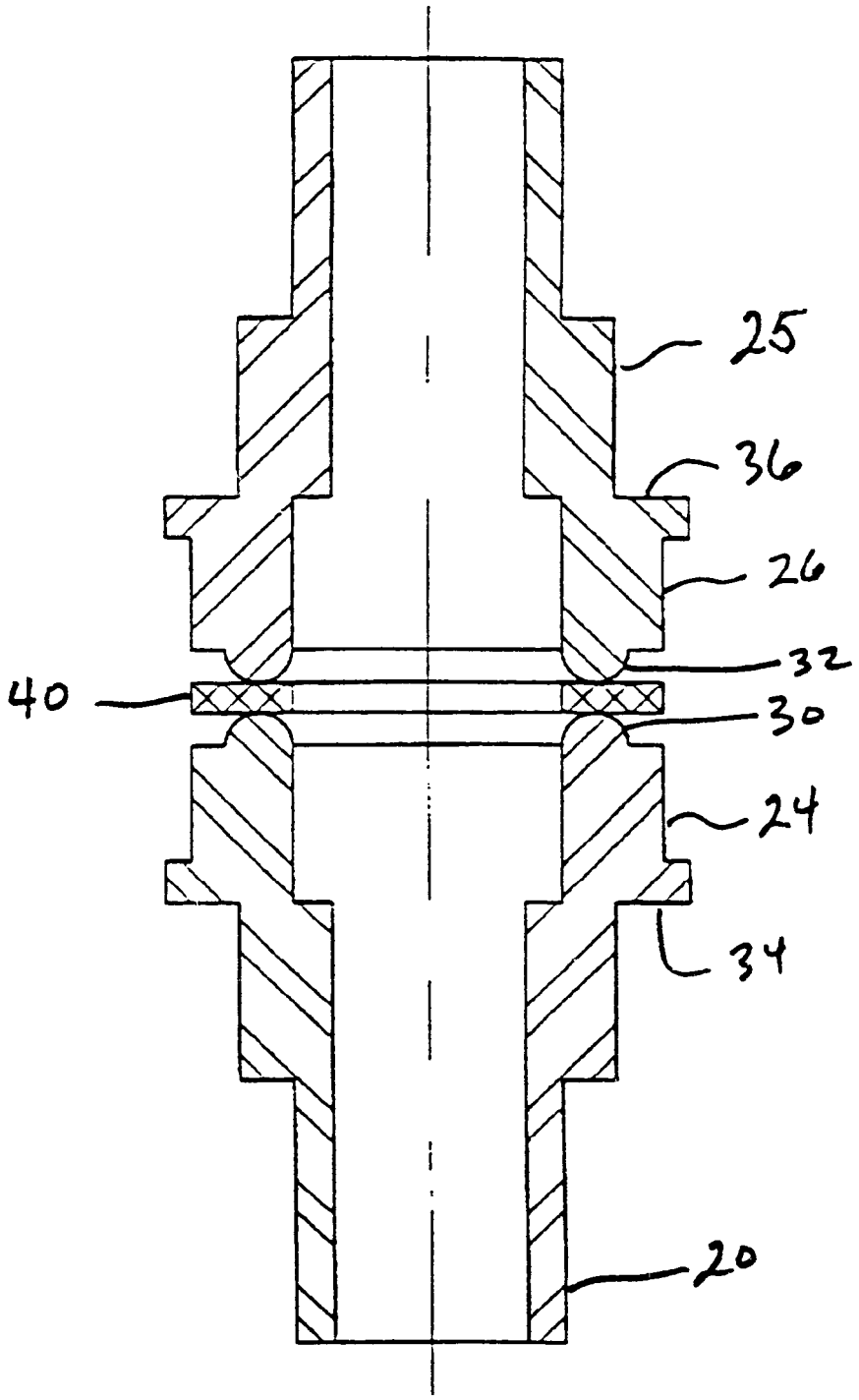
FIG. 2 PRIOR ART
FIG. 2 is a cross-sectional view of a VCR connection as is known in the prior art.
Figure 6:
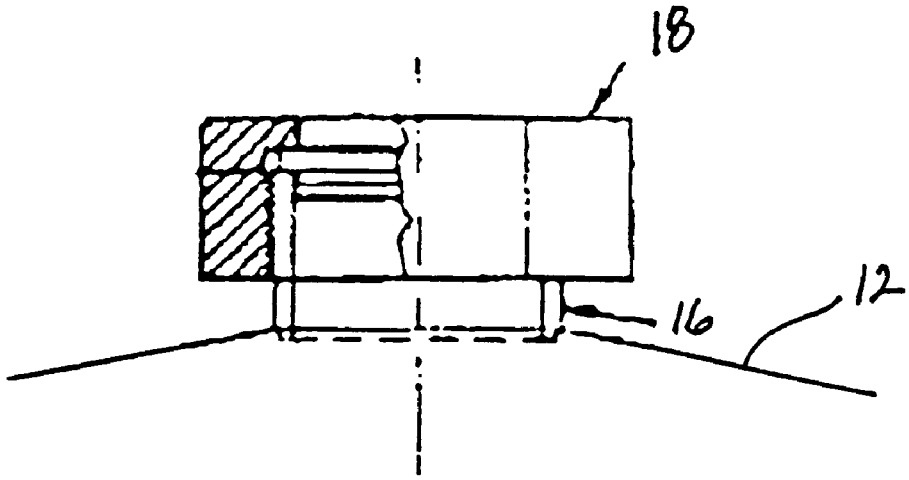
FIG. 6 PRIOR ART
FIG. 6 is an elevation view of the top of a canister showing a port tube and a port tube nut.

Referring to FIG. 1, in a preferred embodiment a bracket according to this invention includes two base plate halves 50*a*, 50*b* and one or more angle brackets 52. The base plate halves 50*a* and 50*b* are joined to form base plate 50, which engages the base of port tube 16 (see FIG. 6). Base plate 50 may be fabricated from a variety of materials, including metals, alloys, ceramics, and plastics. The dimensions of base plate 50 are a matter of design choice. In a presently preferred embodiment, base plate 50 is fabricated from 0.375 inch stainless steel plate. Angle bracket 52 connects to base plate 50 and to the body of valve 28. In the preferred embodiment, bracket 52 may be fabricated from 0.25 inch plate, although other materials and dimensions may be used to implement the invention. The choice of thick metal materials adds density and rigidity to the bracket assembly, enabling the canister unit to withstand shock and other loads placed upon the valves and couplings. (Note that references herein to valves apply equally to other accessories that may be used in connection with a canister.)

In the preferred embodiment, the base plate halves 50*a*, 50*b* may be identical, as illustrated, in which case a base plate consists of two pieces of the same part. Alternatively, each half of the base plate may have a different geometry, in order to best fit the intended application. Each base plate half 50*a*, 50*b* includes semicircular cut-out portion 54, which is designed to precisely fit the outside diameter of the port tube 16. With a precise fit, the base plate halves will uniformly compress or clamp around the port tube when the base assembly bolts 56 are tightened, without crushing or deforming the tube. The length of the base plate may extend across the same plane formed by the valves that are to be braced by the bracket. This orientation is optimal for maximizing the strength of the base plate relative to the impact and stress forces that may be placed on the valve connections.

Figure 3:
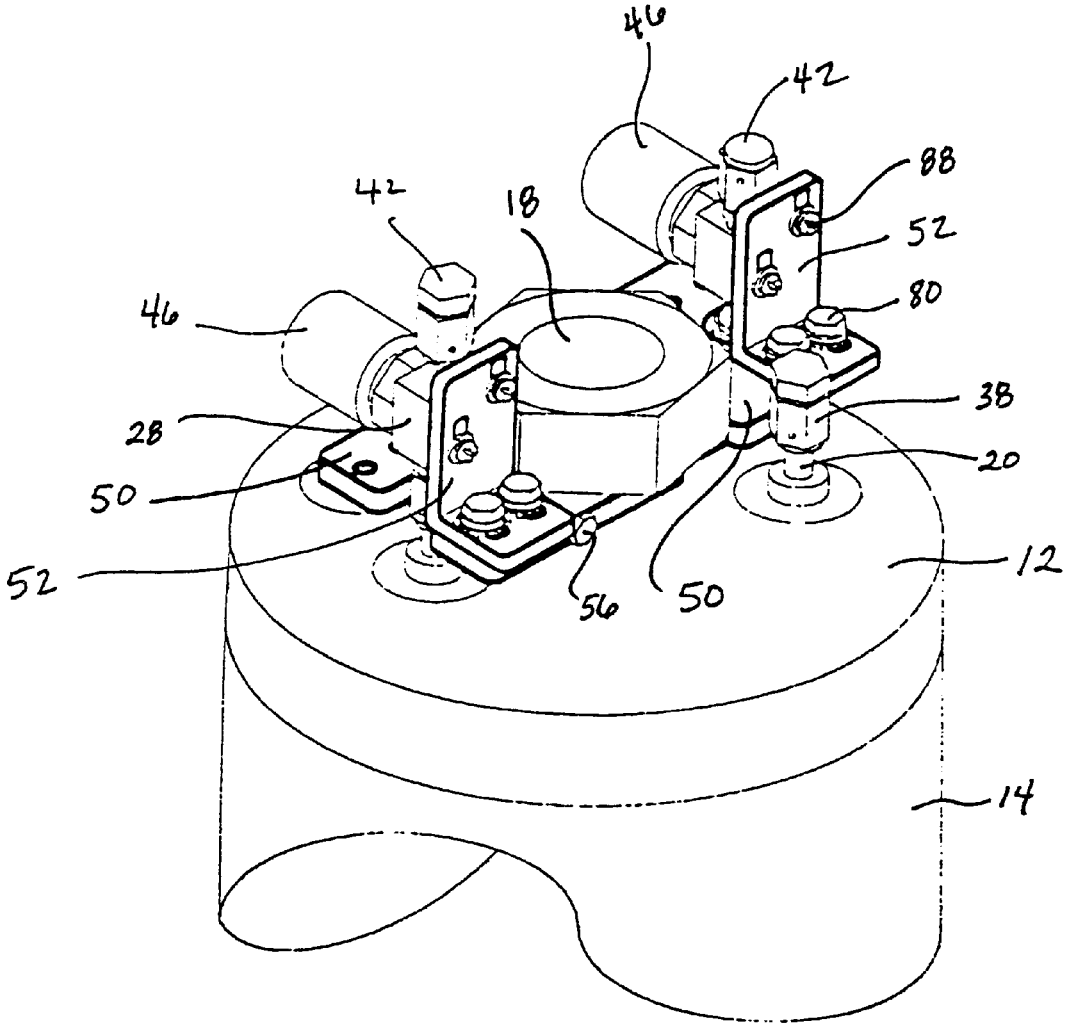
FIG. 3 is an isometric illustration of a bracket according to the invention as assembled in place on a canister.

In the presently preferred embodiment, each base plate half 50*a*, 50*b* is generally rectangular in plan, being about 7 inches long and 1.75 inches wide, fabricated from 0.375 inch thick stainless steel. Each base plate half 50*a*, 50*b* has two bolt holes 66 formed therein coplanar with the base plate and transverse to the long axis of the base plate half. The bolt holes 66 on the two base plate halves are aligned with one another, so that bolts 56 may be inserted therethrough and fastened with nuts 70 to clamp base plate 50 around port tube 16, as shown in FIGS. 1 and 3. Lock washers 68 may be also be provided under nuts 70. It will be appreciated that other fastening systems may alternately be employed. For example, pins or clamping arrangements may be employed to fasten the base plate to the canister, or the components of the base plate may be welded together for a more permanent attachment. In an alternate embodiment, the base plate may comprise a single piece of material, and it may be attached to the canister by removing the port tube nut 18, sliding the base plate 50 over port tube 16, and replacing port tube nut 18 to hold base plate 50 in place.

Figure 4:
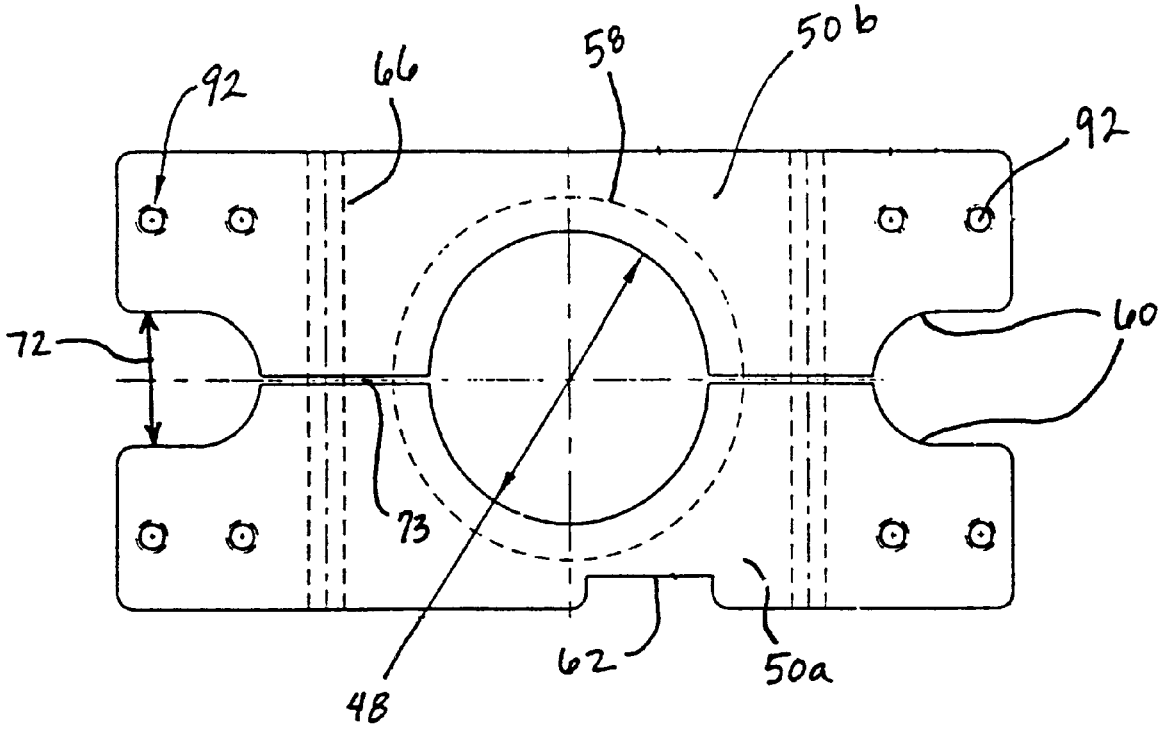
FIG. 4 is a plan view of a base plate in accordance with a preferred embodiment of the invention.

Referring to FIG. 1 and FIG. 4, in a preferred embodiment, where the port tube is a nominal 2 inch tube, base plate 50 has a 2.2 inch diameter circular orifice 48 formed therein that forms when the required two base plate halves are assembled together. A coaxial 2.75 inch diameter counterbore 58 may be formed in the lower side of base plate 50. The counterbore 58 creates a 0.275×0.125 recess around the lower edge of the orifice that makes allowances for a weld bead between port tube 16 and container top cap 12. This allows the base plate halves 50 to rest upon the upper surface of canister top cap 12. The counterbore also allows the assembly to ride lower on the level sensor tube relative to the port tube nut 18, permitting it to be fabricated from thicker steel plate, thus improving the overall strength of the bracket.

Referring to FIG. 4, with the two base plate halves joined to form base plate 50, slots 72 for clearance around delivery tubes 20 and valve assemblies 28 are created by concavities 60 formed in each end of the base of each base plate half. In preferred embodiments, the concavities 60 cooperate to form slots 72 that are approximately 1 inch wide. FIG. 4 shows that when base plate 50 is assembled around port tube 16 there may be a small (e.g. 0.06 inch) gap 73 between adjacent edges of base plate halves 50*a*, 50*b*, to permit a firm clamping force to be applied to port tube 16. Tapped holes 92 may be provided for attachment of angle brackets 52 to base plate 50, as is described below.

Some canisters are fitted with a third or even a fourth delivery tube 20 which, with the coupling body hex nut installed, would obstruct the insertion of a base plate half 50*a*, 50*b* into position around the base of the level sensor tube. A notch 62 may be cut out of the edge of one or both base plate halves 50*a*, 50*b* to allow the plate to be maneuvered around an additional delivery tube and inserted into position around port tube 16. In preferred embodiments, this notch may be about 1 inch wide and about 0.25 inch deep.

Figure 5:
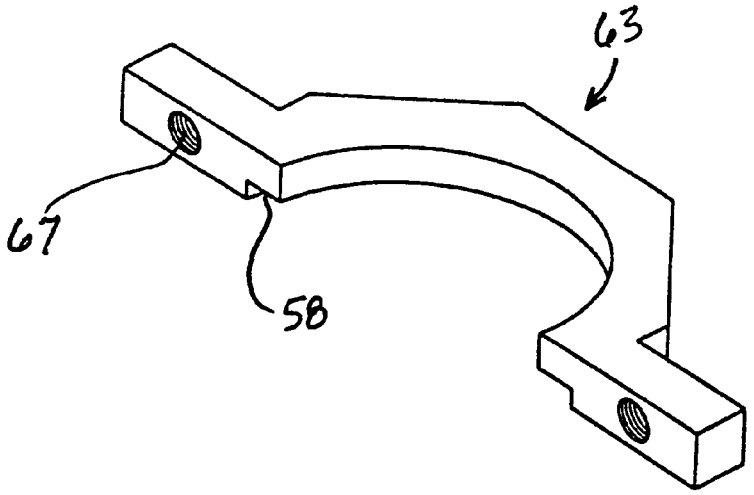
FIG. 5 illustrates a "C" shaped clamp that may be used in an alternative embodiment of the invention.

In an alternative embodiment, one base plate half 50*a* may be replaced by a "C" shaped clamp 63 as shown in FIG. 5, or by a "U-bolt" selected to pass around port tube 16 and through bolt holes 66 in base plate half 50*b* (not illustrated). In the embodiment of "C" clamp 63 shown in FIG. 5, bolt holes 67 may be threaded to eliminate the need for nuts and washers. Counterbore 58 is also shown in this figure.

As shown in FIG. 1, in preferred embodiments one or more angle brackets 52 may be rigidly connected to base plate 50, and valves 28 may then be connected to angle brackets 52. In a presently preferred embodiment, angle bracket 52 is a 0.25 inch thick stainless steel angle having a horizontal flange 94 and a vertical flange 96. (Note that references herein to horizontal and vertical orientation are intended for ease of description, in conjunction with the illustrated embodiments. In other embodiments, the corresponding components may not necessarily be oriented in the same way.) The horizontal flange 94 may be attached to the horizontal base plate 50 by bolts 80 inserted through horizontal flange slots 82 and threadably engaging tapped holes 92 in base plate 50. The horizontal flange slots may be sized for maximum horizontal mobility of the angle bracket 52 without compromising the strength of the connection, and in order to permit alignment of slots 84 in vertical flange 96 of the angle bracket with tapped holes 86 at the back of valve body 28. Vertical flange slots 84 are also dimensioned to allow maximum lateral and vertical tolerance for bolts 88 that are threaded into tapped holes 86 formed in valve body 28, without compromising the strength of the assembly. Various washers 90 may be provided as needed to complete the illustrated connections between angle bracket 52 and base plate 50, and between angle bracket 52 and valve body 28. The combination of base plate 50 and one or more angle brackets 52 provides a stabilizing bracket that has been found to be quite effective in reducing damage to valve/canister connections during shipment and handling of chemical canisters.

Of course, angle brackets and other support means comprising components having other dimensions or geometries and formed from other materials (including but not limited to metals, plastics, ceramics, and composites) are considered to be within the scope of the claims of this patent. In some embodiments, the angle brackets may be welded to the base plate, in which case they may not include a horizontal flange portion, but may be merely the vertical flange portion extending upward from the base plate. Such embodiments would, however, lack the freedom of motion between the base plate and the angle bracket provided by the preferred embodiments as illustrated and described herein.

From the foregoing, it will be apparent that the present invention brings to the art a new valve bracket design in which the bracket connects or clamps immovably to a port tube that is standard on 1A1 type stainless steel canisters commonly used in the chemical industry. In the illustrated embodiment, the bracket design and the high density and rigidity of the stainless steel plate components prevent valve deflection and rotational movement of the valve body, thus protecting the integrity of the seals employed between the valve and the canister. Furthermore, the bracket fully protects the canister/valve assembly and valve seals from levels of impact force that are likely to be encountered during shipping and handling. The bracket can be installed onto the canister prior to or during the valve installation process, or the bracket unit as described and claimed herein can be retrofitted onto a fully assembled canister. This invention may also be adapted for and applied to other types of containers, including but not limited to 200 liter systems.

Further modifications and alternative embodiments of this invention will be apparent to those skilled in the art in view of this description. Accordingly, this description is to be construed as illustrative only and is for the purpose of teaching those skilled in the art the manner of carrying out the invention. It is to be understood that the forms of the invention herein shown and described are to be taken as presently preferred embodiments. Equivalent elements may be substituted for those illustrated and described herein, and certain features of the invention may be utilized independently of the use of other features, all as would be apparent to one skilled in the art after having the benefit of this description of the invention.

We claim:

1. A canister assembly for containing fluids, comprising:

an enclosed canister;

a conduit in communication with the interior of the canister extending external to the canister;

a valve operably coupled to the conduit external to the canister; and a rigid stabilizing bracket removably attached to the canister and removably attached to the valve;

wherein the bracket comprises a first base plate half and a second base plate half, said first and second base plate halves cooperating to form a generally planar base plate that may be rigidly and removably attached to the canister; and a rigid angle bracket having a vertical flange and a horizontal flange, the vertical flange being removably connectable to the valve and the horizontal flange being connected to the base plate; and wherein each of the first and second base plate halves has a semicircular cut-out in an edge adjacent the other base plate such that the cutouts align to form a circular hole in the base plate, the hole having substantially the same diameter as the exterior diameter of a port tube on the canister, whereby the first and second base plates may be assembled in coplanar alignment on opposing sides of the port tube such that the port tube is clamped between the base plate halves.

2. The canister assembly of claim 1, wherein the conduit comprises a sealed coupling.

3. The canister assembly of claim 1, wherein the sealed coupling comprises a VCR coupling.

4. The canister assembly of claim 1, wherein the canister has a port tube and wherein the bracket comprises a base plate comprising two base plate halves, and wherein the two base plate halves are rigidly and removably clamped around the port tube.

5. The canister assembly of claim 4, wherein one of the base plate halves is a "C" shaped clamp.

6. The canister assembly of claim 1, wherein the stabilizing bracket is attached to the canister by a "U-bolt."

7. The canister assembly of claim 1 wherein the base plate includes threaded holes positioned for attachment of an angle bracket using threaded connectors, and wherein the angle bracket includes slots adapted to receive said threaded connectors, such that there is a limited freedom of movement provided between the base plate and the angle bracket when the slots are aligned with the threaded holes.

8. The canister assembly of claim 1, wherein each of the base plate halves and the angle bracket are made of metal that has a thickness of at least 0.25 inch.

9. The canister assembly of claim 1, wherein each of the base plate halves and the angle bracket are made of stainless steel.

10. The canister assembly of claim 1, wherein each of the base plate halves and the angle bracket are made of aluminum.

* * * * *